US005884994A

United States Patent [19]

Herst et al.

[11] Patent Number: 5,884,994

[45] **Date of Patent: *Mar. 23, 1999**

[54] DIRECT-INDIRECT LUMINAIRE WITH IMPROVED DOWN LIGHT CONTROL

[75] Inventors: Douglas J. Herst, Ross; Peter Y. Y. Ngai, Alamo, both of Calif.

[73] Assignee: Peerless Lighting Corporation, Berkeley, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 760,348

[22] Filed: Dec. 4, 1996

Related U.S. Application Data

[63] Continuation of Ser. No. 612,596, Feb. 28, 1996, abandoned.

[51] Int. Cl.[6] ..... F21M 3/14

[52] U.S. Cl. ..... 362/256; 362/217; 362/260; 362/342; 362/346

[58] Field of Search ..... 362/147, 217, 362/255, 256, 260, 296, 297, 304, 342, 346

[56] References Cited

U.S. PATENT DOCUMENTS

| | | | |
|---|---|---|---|
| 2,525,556 | 10/1950 | Marchisio | 362/342 |
| 3,389,246 | 6/1968 | Shemitz | 362/342 X |
| 4,293,900 | 10/1981 | Dziubaty | 362/342 |

OTHER PUBLICATIONS

Neo–Ray Lighting Products, Inc.; *Neo–Ray Naturally*; 1989, pp. 41–45.

*Primary Examiner*—Stephen F. Husar
*Attorney, Agent, or Firm*—Donald L. Beeson

[57] ABSTRACT

A direct-indirect luminaire is provided with a direct light control structure between the luminaire's light source and the down light openings in the luminaire's housing. The down light control structure has an interior light capture which extends to meet the light source and which is shaped to substantially conform to the shape of a capturable surface of the light source. The down light control structure captures and directs substantially all of the light emitted from the captured portion of the light source through the housing's down light opening to provide improved control over the down light component of the luminaire.

14 Claims, 5 Drawing Sheets

DIRECT-INDIRECT LUMINAIRE WITH IMPROVED DOWN LIGHT CONTROL

This application is a continuation of application Ser. No. 08/612,596, filed Feb. 28, 1996, now abandoned.

BACKGROUND OF THE INVENTION

The present invention generally relates to architectural lighting, and more particularly relates to luminaires that provide both direct and indirect lighting, so called "direct-indirect" luminaires. The present invention finds particular application in the field of linear fluorescent lighting where ambient light is produced from fluorescent lamps mounted in an elongated housing having a predetermined length and characteristic cross-sectional shape.

Linear direct-indirect fluorescent lighting has been known for many years. Such fixtures normally provide indirect or "up" lighting through the top of the luminaire housing which is open (or is covered by a light transmitting element such as a lens cover), and a direct or "down" lighting component through one or more openings in the bottom of the housing, openings which are typically covered by lenses, baffles, or louvers to shield the luminaire's fluorescent lamps from direct view at high viewing angles. In many such fixtures, the available light output from a direct-indirect luminaire mostly escapes as indirect light through the top opening of the luminaire housing while only a fraction of the available source light contributes to the down lighting. Other than shielding the light source, there is relatively little control over the down light component of the fixture. The present invention overcomes these disadvantages by providing a direct-indirect luminaire which greatly increases the control of the down light component of the luminaire and which permits a lighting designer to increase the amount of down light in relation to the luminaire's total available light output.

SUMMARY OF THE INVENTION

The direct-indirect luminaire of the invention includes a housing having a top up light opening for indirect lighting and at least one bottom down light opening for producing a down light component from the luminaire. A light source mounted in the housing is positioned to provide a capturable light-emitting surface generally in opposition to the housing's down light opening as a down light source. The luminaire's down light component is captured and controlled from this surface by a down light control structure mounted between the housing's down light opening and the light source. The down light control structure has an interior light capture end shaped and constructed to substantially conform to and mate with the shape of the capturable surface of the luminaire's light source. This control structure extends to meet a predetermined portion of the light source's capturable surface when the control structure and light source are in their operative positions in the housing. It further acts to capture and direct substantially all of the light emitted from the captured portion of the light source's surface through the housing's down light opening. By forcing all of the captured light through the such openings, the amount of down light from the luminaire, as a percentage of the total available light output, can be increased, and the down light component of the luminaire can be more easily controlled.

Therefore, it is the primary object of the present invention to provide enhanced control over the down light component of a direct-indirect luminaire and to provide the lighting designer with the ability to increase the down light component when desired. Another object of the invention is to provide the foregoing advantages while at the same time permitting the light source to be shielded from direct view at high viewing angles as in conventional direct-indirect luminaires. Other objects of the invention will be apparent from the following specification and claims, as well as the accompanying drawings.

DESCRIPTION OF THE DRAWINGS

FIG. 5C additionally shows a possible rotating feature for the down light control structure.

DETAILED DESCRIPTION OF THE ILLUSTRATED EMBODIMENT

Figure 1:
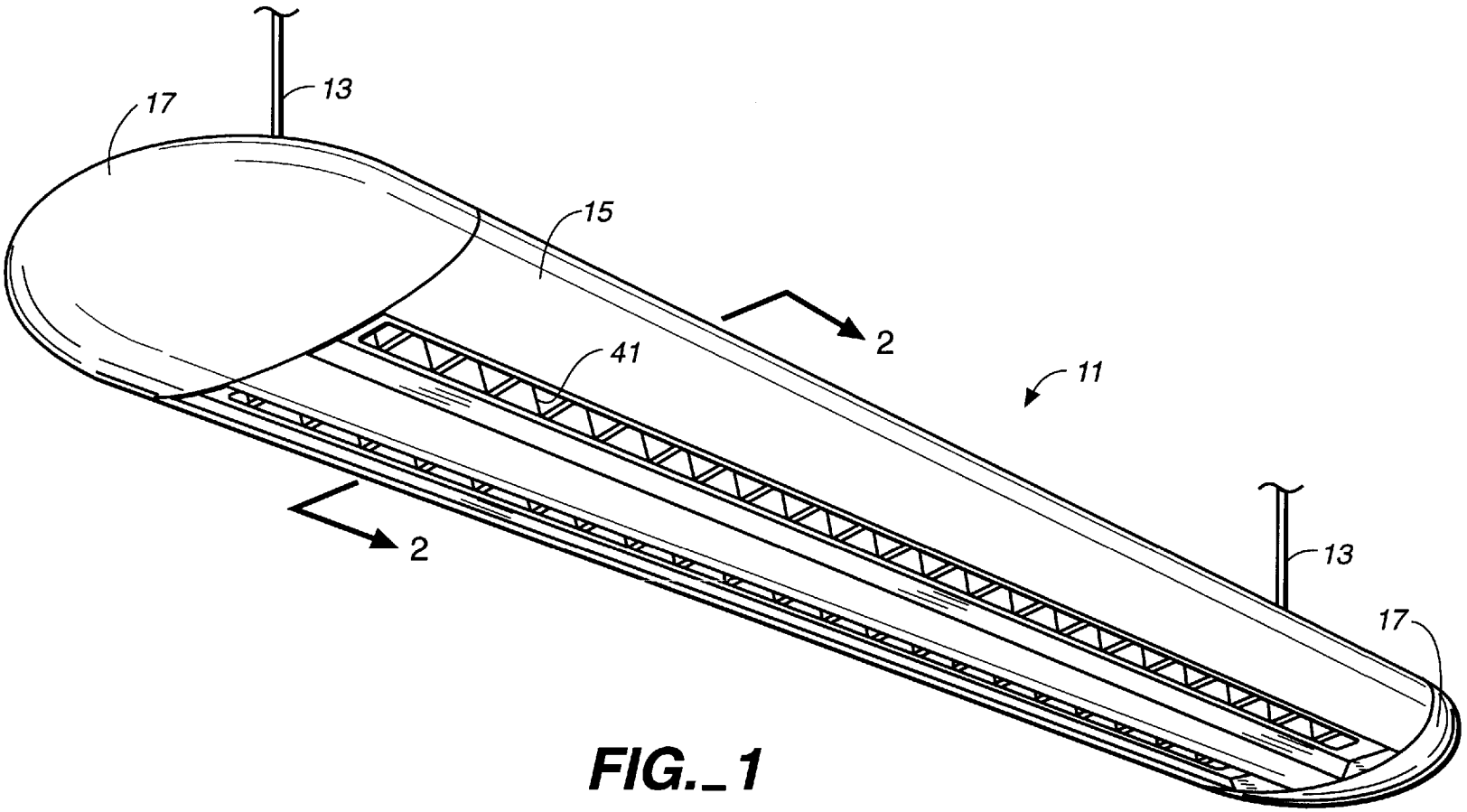
FIG. 1 is a bottom perspective view of a direct-indirect luminaire showing direct light openings in the bottom of the luminaire's housing and a down light control structure for controlling the down light component of the luminaire in accordance with the invention.
Figure 2:
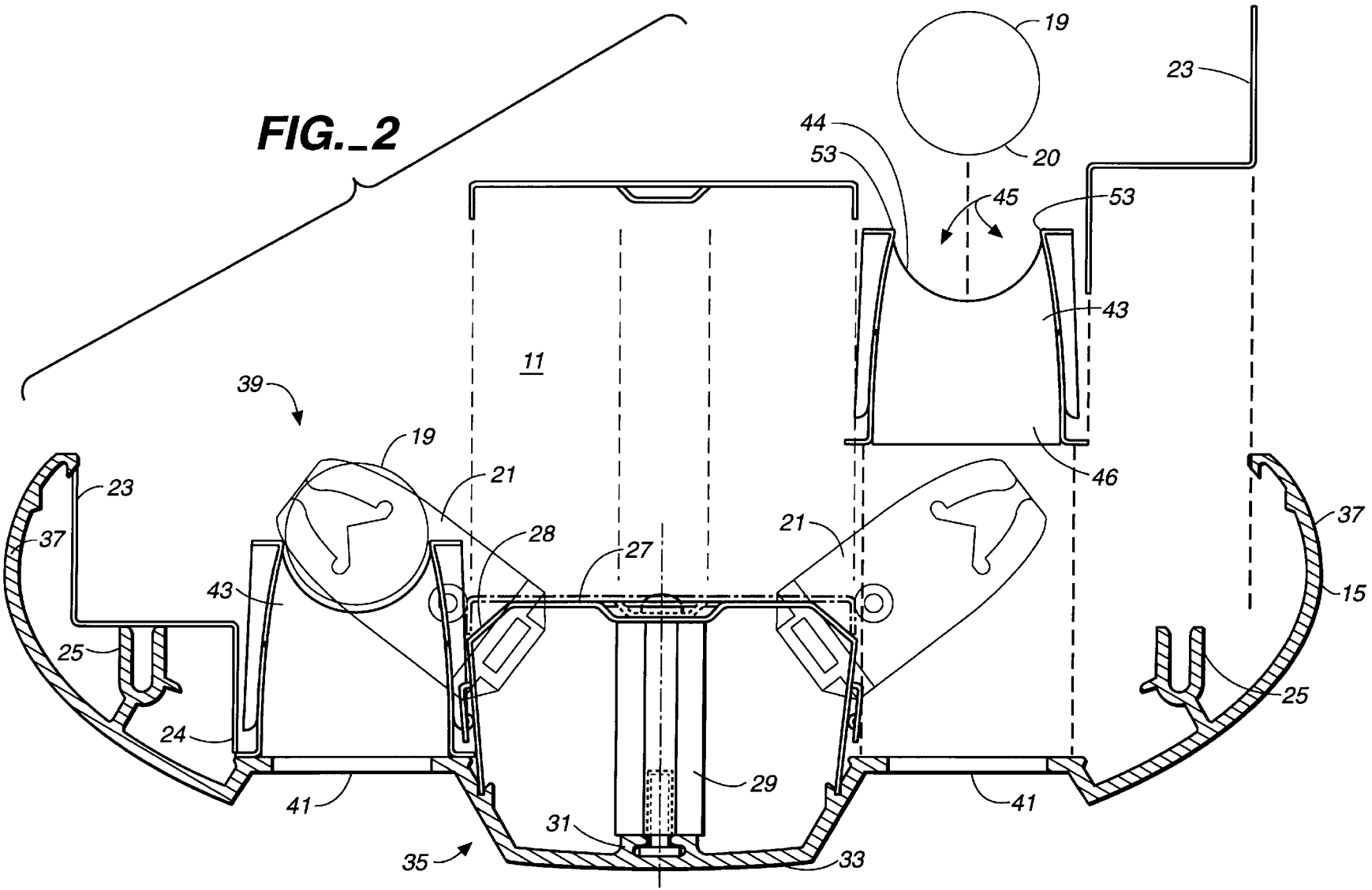
FIG. 2 is a partially exploded, cross-sectional view in side elevation of the direct-indirect luminaire shown in FIG. 1.

Referring now to the drawings, FIGS. 1 and 2 illustrate a linear fluorescent direct-indirect luminaire 11 suspended from an overhead ceiling (not shown) by suspension cables 13. An elongated luminaire housing 15, which may be fabricated of extruded aluminum and which is terminated by end caps 17, supports a light source in the form of two fluorescent lamps 19 by means of lamp sockets 21 provided at suitable intervals along the length of the housing. To increase the efficiency of the indirect lighting component of the luminaire, the housing additionally supports internal side reflectors 23 by means of extruded screw channels 25, as well a center reflector 27 supported at an elevated position by means of suitably spaced apart hex nut stand-offs 29 secured by screw fasteners to T-channel 31 extruded on the interior surface of the housing bottom wall 33.

Housing 15 of luminaire 11 has a bottom portion 35 and upwardly extending lateral sidewalls 37, the upper extremes of which define top opening 39 through which direct and reflected source light is emitted to produce indirect lighting. The bottom portion 35 of the housing, in turn, has two elongated down light openings 41 extending the length of the housing for passing some of the available source light downward below the luminaire to produce a component of direct lighting. The direct lighting component is strictly controlled as hereinafter described by a down light control structure in the form of elongated light cell strips 43 placed between down light openings 41 and their associated lamps 19.

Each of the lamps 19 provides a capturable light-emitting surface 20 which faces downwardly in general opposition to the down light opening 41 over which the lamp is positioned. A light cell strip 43 extends between the capturable surface of each lamp 20 and its respective down light opening, with the strip's interior light capture end 45 extending all the way up to the capturable lamp surface. It will be seen from the description below that when lamps 19 are inserted into lamp sockets 21 they nest in the concave 44 of the light cell's interior end 45, resulting in a minimal clearance between the light cell structure and the lamp through which source light can escape.

The construction of the light cell strips 43 is now described in greater detail with reference to FIGS. 2–5. Each light cell strip comprises elongated, opposed sidewalls 47 and a series of crosswalls 49 extending between the sidewalls at equal intervals over the length of the strip. The sidewalls and crosswalls are suitably fabricated of stamped and bent metal parts, with each sidewall extending inwardly from its footing 51 to provide inside, curved reflective wall surfaces 52, which can be specular, diffuse, or semi-specular according to the particular lighting design requirements. Crosswalls 49 have notched lateral edges 50 which fit and lockingly engage into slots 55 formed in the top end of the sidewalls so as to secure the crosswalls in place to form a rigid cell structure. The opposed faces 57, 58 of the crosswalls complete the individual cells of the light cell structure and provide additional reflective surfaces for each light cell. The opposed reflective surfaces of the crosswalls can similarly be provided with a specular, diffuse, or semi-specular characteristics. It will be appreciated that the light cells can be designed to produce a variety of different light distribution patterns, including wide and narrow distribution patterns, to meet a different lighting requirements.

Figure 3:
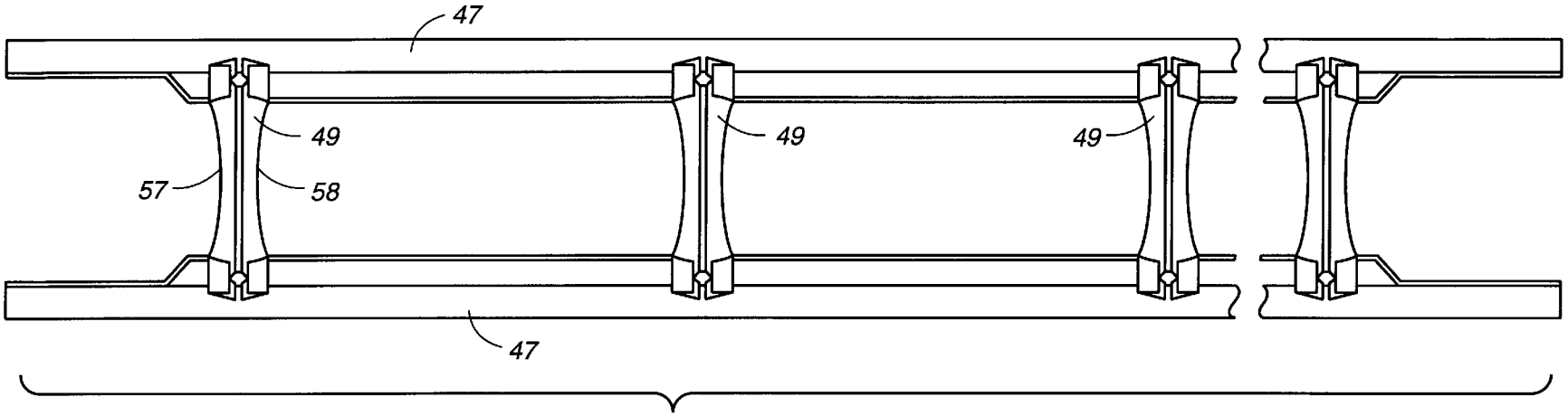
FIG. 3 is a top plan fragmentary view of the down light control structure of the present invention.
Figure 4:
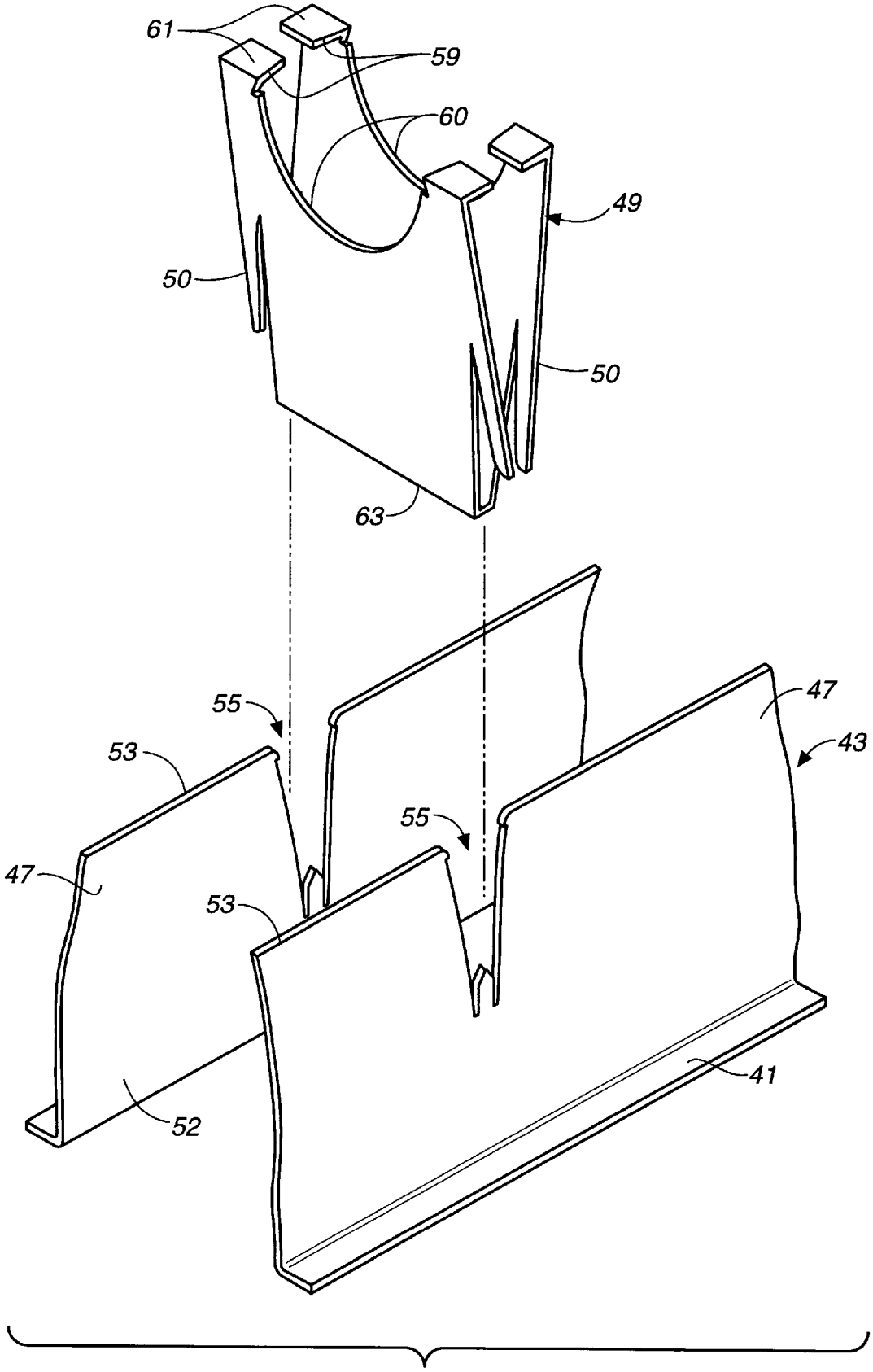
FIG. 4 is a top perspective fragmentary view of the down light control structure of FIG. 3 showing the assembly of the crosswall and sidewalls of the structure.

Referring to FIGS. 3 and 4, it can be seen that the interior end 45 of each light cell strip 43 is formed by a series of edges that meet with lamps 19 when the lamps and light cell strips are in their operative positions. More specifically, a light capturing concave 44 provided at interior end 45 to huge the cylindrical fluorescent lamps is formed by the longitudinal interior edges 53 of sidewalls 47, the semi-circular top edges 57 of crosswalls 49, and the longitudinally extending edges 59 of tabs 61 found at the top of the crosswall. The crosswalls' semi-circular top edges 57 have a radius which causes top edges 57 to substantially align with upper edges 53 of the sidewalls when the crosswalls are inserted, thereby providing a continuous light barrier along the surface of the lamp when the lamp is nested into the concave. It can be noted that the act of inserting the crosswalls in sidewall slots 55 will force the opposed faces of the crosswall together about the bend 63 to eliminate any gap between tabs 61.

Figure 5C:
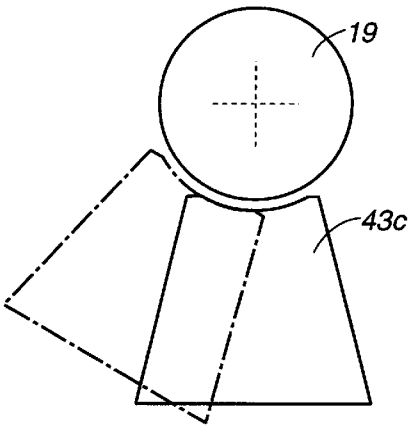
FIGS. 5A–5C are pictorial views of the fluorescent light source of the direct-indirect luminaire of FIG. 1 with different configurations for the down light control structure.
Figure 5B:
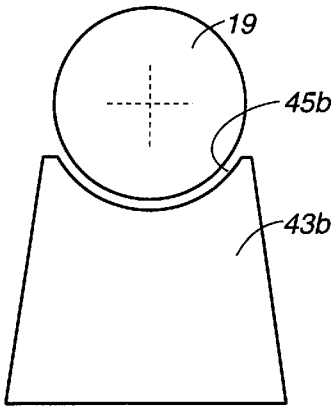
Figure 5A:
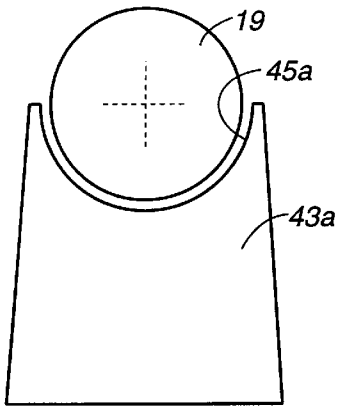

It is further noted that, in the FIG. 2 embodiment of the invention, interior end 45 of each of the light strips 43 encloses nearly 180° of the bottom surface 20 of the lamps, thereby maximizing the amount of down light forced through direct light opening 41. However, referring to FIGS. 5A, 5B, and 5C, it can be readily appreciated that the light cell strips can be constructed to capture smaller portions of the lamp's surface, depending on the requirements of a particular lighting design. For example, FIG. 5A graphically shows the down light from lamp 19 controlled by a light cell strip 43*a* having interior end 45*a* that captures a full 180° of the lamp's surface as in the FIG. 2 embodiment. On the other hand, the down light from lamp 19 in FIG. 5B is controlled by light cell strip 43*b* having an interior end 45*b* that captures roughly 120° of the lamp's surface, whereas in FIG. 5C the interior end 45*c* of light cell strip 43*c* captures only about 60° of the surface of lamp 19. In each of these figures, the light cell strip 43*a*, 43*b*, 43*c* will direct a different percentage of the total available source light from lamp 19 through the direct light openings 41 of the fixture. By suitably sizing the interior end of the light cell strip, the down light component of the direct-indirect luminaire can be carefully tailored to different lighting design requirements. Additionally, as shown in FIG. 5C, the light cell strip can suitably be rotated about the lamp surface to control the directionality of the down light, as well as the amount of down light. Such rotation would require a suitable mounting for the light cell strip within the fixture housing and a down light opening design suitable for accommodating the rotation.

Assembly of the direct-indirect luminaire of the invention is best understood in reference to FIG. 2. Assembly is readily accomplished by placing light cell strips 43 over direct light openings 41, and installing the reflectors, that is, side reflectors 23 onto screw channels 25 and center reflector 27 onto hex stand-offs 29. The reflectors will act to hold the light cell strips in place: the bottom leg 24 of side reflectors 23 will bear against the bottom footing 51 of the strips, while the down-turned edges 28 of the center reflector will abut the outwardly projecting lateral edges 50 of the strips' crosswalls. Once the luminaire is assembled, installation of lamps 19 will place the lamps in their nested position within concave 44 of the interior end 45 of each of the light cell strips, and each of the light cell strips will force substantially all of the light emitted by the surface of the lamps captured thereby through down light openings 41. Light emitted from the lamp surfaces not captured by the light cell strip will be available for indirect lighting.

Figure 6:
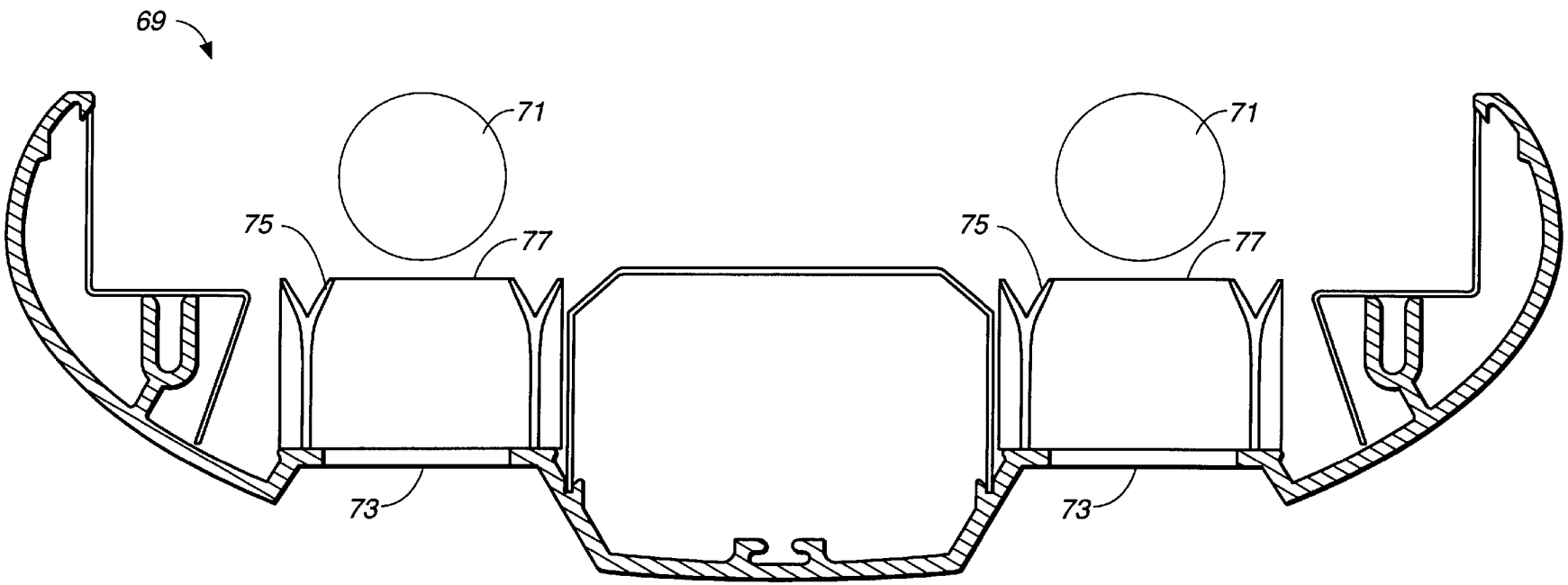
FIG. 6 (PRIOR ART)
FIG. 6 shows a prior art direct-indirect lighting fixture wherein baffles are placed between the light source and the down light opening of the fixture housing.

FIG. 6 shows a prior art direct-indirect luminaire wherein lamps 71 are positioned over down light openings 73 with light baffle strips 75 placed between the lamps and the down light openings to shield the lamps from direct view. Because the top 77 of each baffle 73 is not designed to capture light as it comes off the lamp surface in the manner of the present invention, any substantial degree of control over the down light component of the luminaire is lost. With such designs, the amount of down light as a percentage of the total available light is relatively small, and a relatively large amount of down light from the luminaire is difficult to obtain without large down light openings in the luminaire housing.

Therefore, it can be seen that the present invention provides direct-indirect luminaire that increases the degree of control that can be obtained over the down light component of the luminaire. The invention permits direct-indirect luminaire designs having an increased down light component for a given down light opening size and increased design flexibility in tailoring the luminaire to different lighting requirements. While the invention has been described in considerable detail in the foregoing specification and the accompanying drawings, it is understood that it is not intended that the invention be limited to such detail, except as necessitated by the following claims.

What I claim is:

1. A direct-indirect luminaire comprising a housing having an up light opening and at least one down light opening, a light source mounted in said housing for providing source light that is emitted through both said up and down light openings, said light source providing a capturable surface generally in opposition to said down light opening, and a down light control structure mounted in said housing between the light source and the down light opening therein, said down light control structure having an interior light capture end extending to meet a predetermined portion of the capturable surface of said light source so as to capture and direct substantially all the light emitted from the portion of the light source surface captured thereby through said down light opening.

2. The direct-indirect luminaire of claim 1 wherein said down light control structure includes at least one light cell for capturing and directing substantially all the light from the predetermined portion of the capturable surface of said light source through said down light opening in a predetermined light distribution pattern.

3. The direct-indirect luminaire of claim 1 wherein said down light control structure includes sidewalls and crosswalls which form light cells for capturing and directing substantially all the light from the predetermined portion of the capturable surface of said light source through said down light opening.

4. The direct-indirect luminaire of claim 3 wherein the sidewalls of said down light control structure are shaped to produce a predetermined light distribution.

5. The direct-indirect luminaire of claim 3 wherein the reflective sidewalls and crosswalls of said light cell are specular reflectors.

6. The direct-indirect luminaire of claim 3 wherein the reflective sidewalls and crosswalls of said light cell are diffuse reflectors.

7. The direct-indirect luminaire of claim 3 wherein the reflective sidewalls and crosswalls of said light cell are partially diffuse, partially specular reflectors.

8. The direct-indirect luminaire of claim 3 wherein said light source includes at least one cylindrical lamp having a capturable cylindrical surface, and wherein the cross-walls of said light cells have concave top edges conforming to said cylindrical surface.

9. The direct-indirect luminaire of claim 8 wherein said down light control structure is rotatable about the capturable cylindrical portion of said lamp for adjusting the directionality of the light directed through the down light opening of said housing.

10. The direct-indirect luminaire of claim 1 wherein said down light control structure is rotatable about the capturable cylindrical portion of said lamp for adjusting the directionality of the light directed through the down light opening of said housing.

11. The direct-indirect luminaire of claim 3 wherein said down light control structure is rotatable about the capturable cylindrical portion of said lamp for adjusting the directionality of the light directed through the down light opening of said housing.

12. A linear direct-indirect luminaire comprising an elongated housing having an up light opening and a down light opening extending longitudinally of said housing, a linear light source mounted in and extending longitudinally of said housing for providing source light that is emitted through both said up and down light openings, said light source providing a capturable surface generally in opposition to said down light opening, and an elongated down light control structure mounted in said housing between said light source and the down light opening of said housing for directing source light through said down light opening, said down light control structure having an interior light capture end extending to meet a predetermined portion of the capturable surface of said linear light source over substantially the length of said down light openings, said light capture end being shaped to conform to the shape of the capturable surface of said light source for capturing and directing substantially all the light emitted from the portion of the light source surface captured thereby through said down light opening.

13. The linear indirect luminaire of claim 12 wherein two parallel, elongated down light openings extend longitudinally of said housing and an elongated down light control structure is provided for each of the down light openings of said housing.

14. A linear direct-indirect luminaire comprising an elongated housing having an up light opening and a down light opening extending longitudinally of said housing, a cylindrical fluorescent lamp mounted in and extending longitudinally of said housing above said down light opening, said fluorescent lamp providing a capturable cylindrical surface generally in opposition to the down light opening, and an elongated light cell structure mounted in said housing between said fluorescent lamp and the down light opening in said housing for directing source through said down light opening, said light cell structure having elongated, parallel sidewalls and crosswalls connected between said side walls to form a series of individual light cells, said sidewalls having longitudinal interior edges that extend to meet the cylindrical surface of said fluorescent lamp, and said crosswalls having semi-circular top edges that likewise extend to meet the cylindrical surface of said fluorescent lamp, the radius of the semi-circular top edges of said crosswalls being substantially the same as the radius of said fluorescent lamp to closely surround said lamp, and the light cells formed by the sidewalls and crosswalls of said light cell structure extending from said lamp to the down light opening of said housing so as to direct source substantially all the source light captured by said light cell structure through said down light opening.

* * * * *